US006253913B1

(12) United States Patent
Suk

(10) Patent No.: US 6,253,913 B1
(45) Date of Patent: Jul. 3, 2001

(54) GOLF BAG HAVING A STORAGE COMPARTMENT FOR A TRIPOD LEG SUPPORT

(76) Inventor: Young Suk, 270 Glen Cove Ave., Sea Cliff, NY (US) 11579

( * ) Notice: Subject to any disclaimer, the term of this patent is extended or adjusted under 35 U.S.C. 154(b) by 0 days.

(21) Appl. No.: 09/531,313

(22) Filed: Mar. 20, 2000

(51) Int. Cl.[7] ..... A63B 55/00; A63B 55/06

(52) U.S. Cl. ..... 206/315.5; 206/315.7; 248/96

(58) Field of Search ..... 248/96; 206/315.5, 206/315.7; 29/428

(56) References Cited

U.S. PATENT DOCUMENTS 1,934,084 * 11/1933 Murphy ..... 206/315.5 X
2,282,842 * 5/1942 Abell ..... 206/315.7 X
2,283,412 * 5/1942 Bright ..... 206/315.5
5,402,883 * 4/1995 Shin ..... 206/315.5 X
5,415,285 * 5/1995 Reimers ..... 206/315.7
5,560,479 * 10/1996 Leyba et al. ..... 206/315.5

* cited by examiner

*Primary Examiner*—Sue A. Weaver
(74) *Attorney, Agent, or Firm*—Myron Amer PC

(57) ABSTRACT

A zippered storage compartment for a golf bag leg support using two zipper pulls, both tracking down to open the storage compartment after which one zipper pull alternately tracks up and down in coordinated relation to the alternating non-use and in-use condition of the leg support as occurs after most golf shots, and the other zipper pull tracks up to close the compartment at the end of the golf round to contribute to obviating damage to the leg support during the intervals between golf rounds.

1 Claim, 4 Drawing Sheets

GOLF BAG HAVING A STORAGE COMPARTMENT FOR A TRIPOD LEG SUPPORT

The present invention relates to improvements for golf bag leg supports, the improvements more particularly providing a storage compartment for the leg supports during off the golf course non-use and, primarily for appearance sake, also on the golf course during alternating opening and closing of the support legs.

BACKGROUND OF THE INVENTION

Field of the Invention

After a golf round, it is desirable to stow the golf bag support legs in a storage compartment both for appearance sake and also to minimize any contact of the legs or their leg-opening wire spring mechanism that might result in damage. As illustrated in U.S. Pat. No. 2,283,412 for "Golf Bag Support" to W. H. Bright on May 10, 1942, a compartment centrally located on the rear surface of the golf bag is zippered open to release the legs from their storage condition within the compartment so as to partake of alternating pivotal traverses into opening and closing movements through the zipper opening. The length portions of cooperating panels of the compartment adjacent the zipper teeth which bound therebetween the zipper opening however are in the path of movement of the leg-opening and leg-closing pivotal traverses, and consequently contact with these panels and, although nominal, this contact adversely effects the operation of the legs. Even more of an inconvenience, the zipper opening remains open during play and is a repository for debris.

SUMMARY OF THE INVENTION

Broadly, it is an object of the present invention to provide a golf bag leg mechanism storage compartment overcoming the foregoing and other shortcomings of the prior art.

More particularly, it is an object to coordinate the opening and closing of the support legs with the opening and closing of the storage compartment so that there is no interference with the operation of the support legs and, in fact, the closing of the zipper openings of the storage compartment facilitates the closing of the support legs, all as will be better understood as the description proceeds.

BRIEF DESCRIPTION OF THE DRAWINGS

The description of the invention which follows, together with the accompanying drawings should not be construed as limiting the invention to the example shown and described, because those skilled in the art to which this invention appertains will be able to devise other forms thereof within the ambit of the appended claims.

DESCRIPTION OF THE PREFERRED EMBODIMENT

Figure 1:
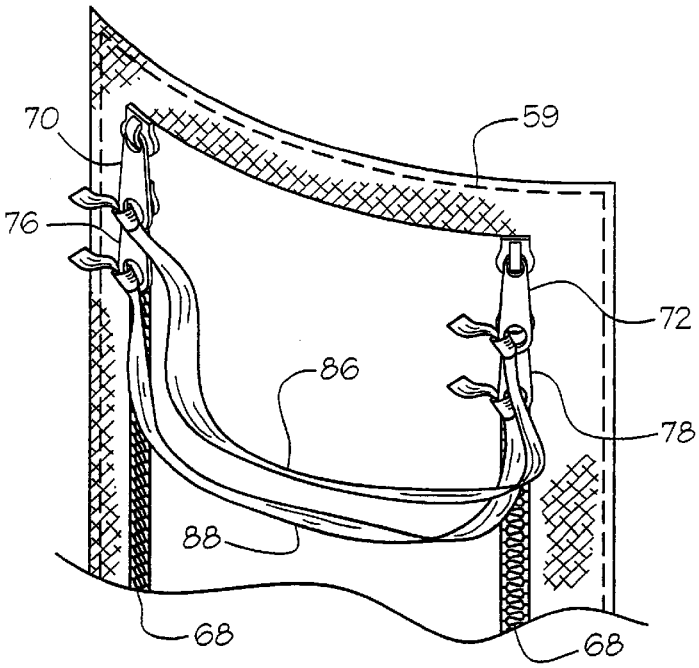
FIG. 1 is a partial perspective view of the zipper components for the leg storage compartment for a golf bag according to the present invention.

It is a common popular practice to provide a tripod leg support, generally designated 10, in attached relation, as at 12, to the rear surface 14 of the circular wall 16 of a golf bag 18 so that the golf clubs 20 are readily accessible in the storage area 22 bounded by the circular wall 16. Mobility requires, of course, that the left 24 and right leg 26 of the tripod retract back from their open angular golf bag-supporting depicted positions, as noted at 28, into flat out-of-the way positions, as at 30, against the golf bag rear surface 14. The opening and closing of the legs 24 and 26 occurs after most fairway golf shots as the golfer moves down a fairway to a putting green. This repetitive alternating operating mode of the legs 24, 26 is achieved in a well known manner, as exemplified by that described and illustrated in U.S. Pat. No. 5,154,377 for "Golf Bag Stand" issued on Oct. 13, 1992 in which the upper ends 32 of the legs 24, 26 are mounted on spaced apart pivots 32 and 34 adjacent a top of the golf bag 18 so as to partake of opposite pivotal traverses 36 between the noted open and closed positions 28 and 30 in response to leg-operating means, generally designated 38, including a lower lever component 40 which when the golf bag 18 is grounded, as at 42, is effective to open the legs 24, 26 and when the golf bag 18 is raised, preparatory to movement down the fairway, is effective to retract the legs 24, 26 under spring urgency, into their flat position against the bag 18, as noted at 30.

In the combination, by attachment 12, of the tripod leg support 10, to the golf bag 18, the closed leg position 30 is advantageously positioned in an out of the way storage compartment construction on the rear 14 of the golf bag 18 to thereby significantly contribute to providing a neat appearance to the golf bag during play as well as during travel to and from the golf course, as well as providing other significant benefits, as will now be described in detail.

Figure 2:
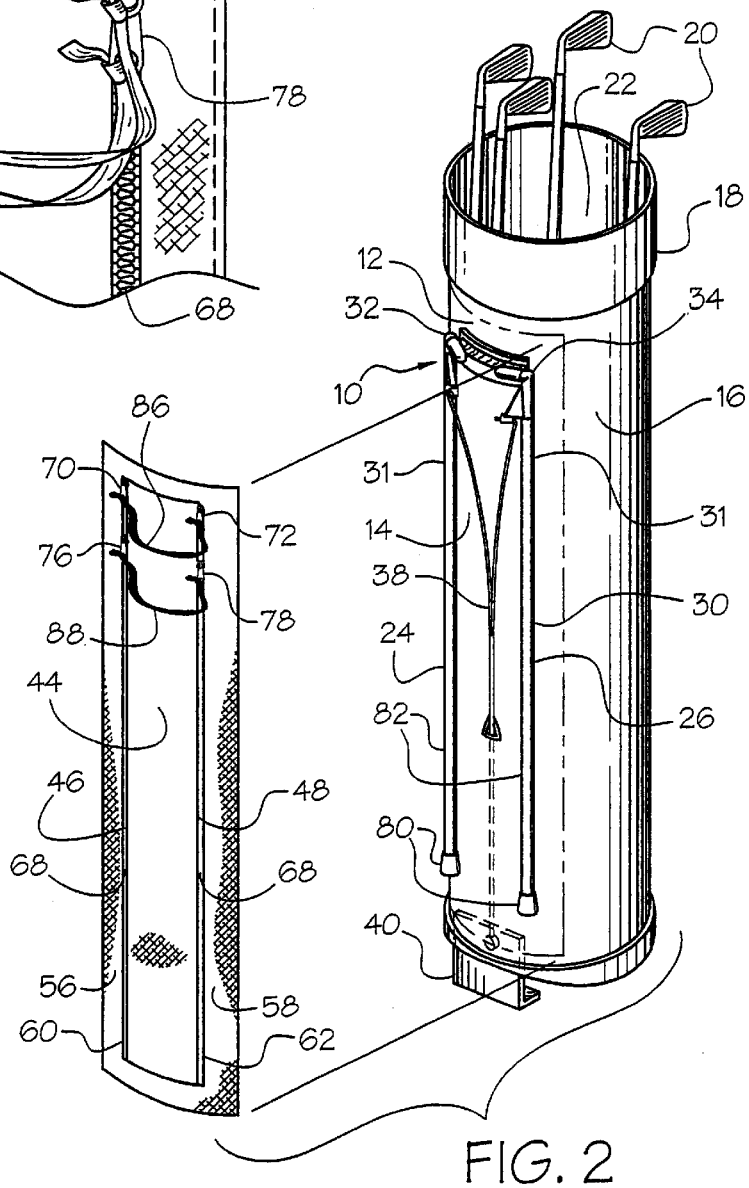
FIG. 2 is an exploded perspective view of the golf bag with an exposed leg mechanism that in use is stored within a compartment formed by an attached panel component.
Figure 3:
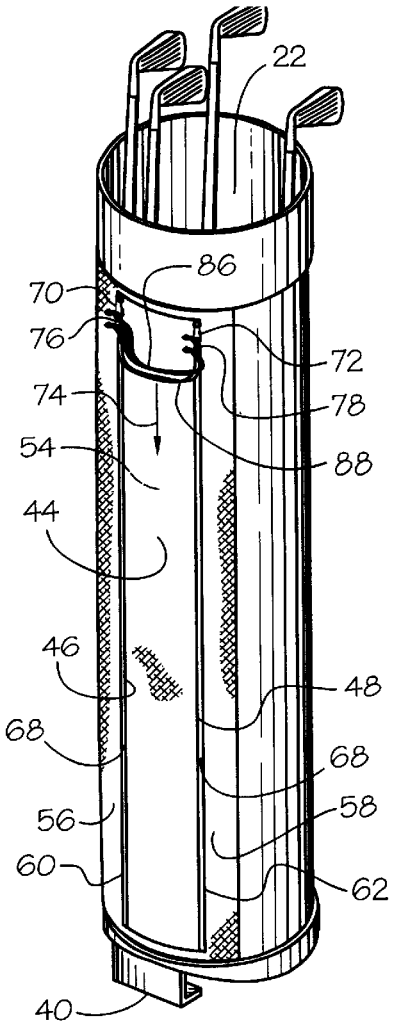
FIG. 3 is a perspective view of the golf bag with the attached component-forming panel component.
Figure 4A:
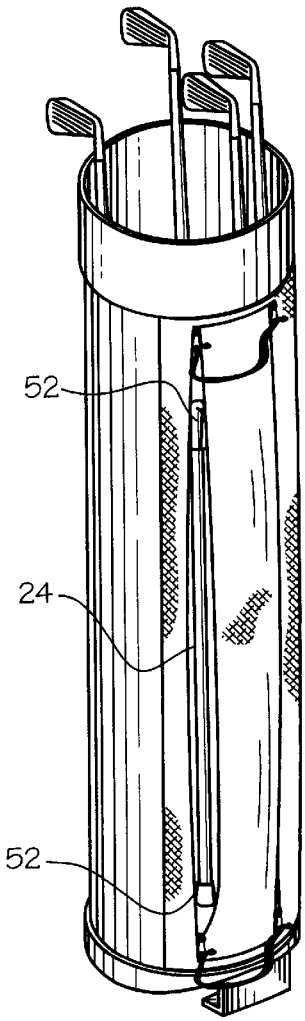
FIG. 4A is a left rear perspective view projected from FIG. 3.
Figure 4B:
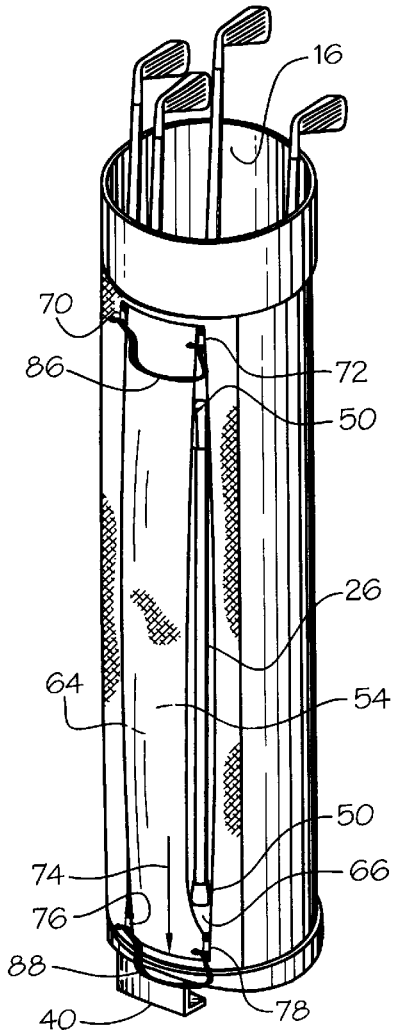
FIG. 4B is a right rear perspective view projected from FIG. 3.
Figure 5:
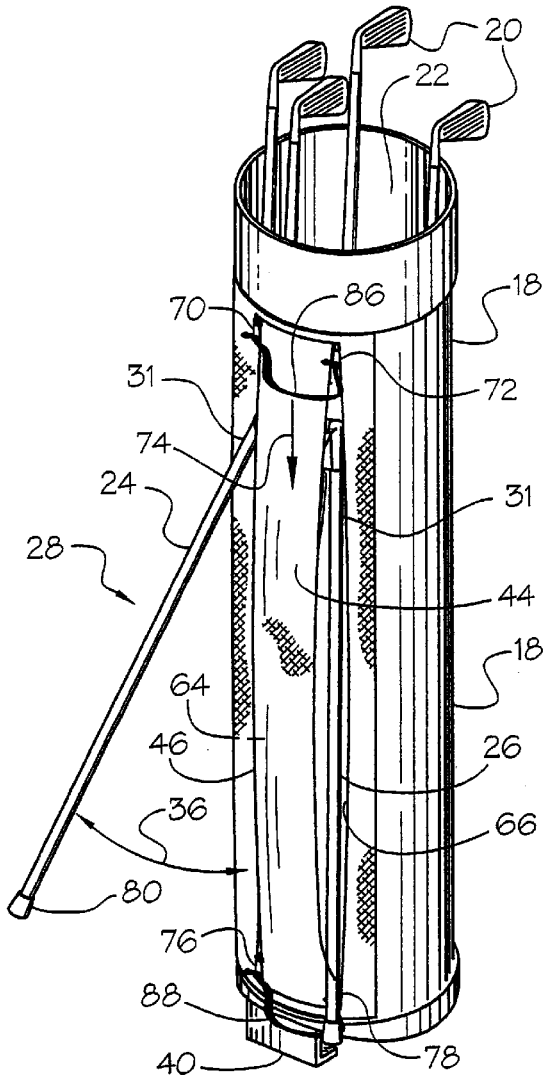
FIG. 5 is a perspective view illustrating the movement of the leg components into golf bag supporting positions.
Figure 6:
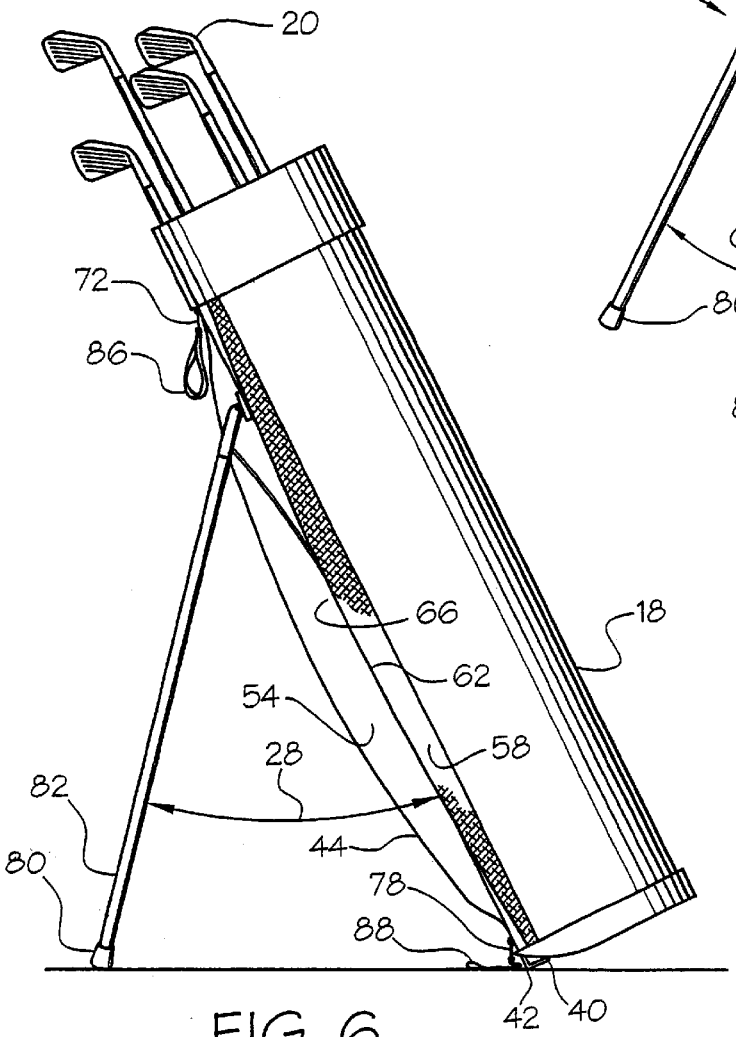
FIG. 6 is a side elevational view of the leg components in a tripod golf bag supporting configuration.
Figure 7:
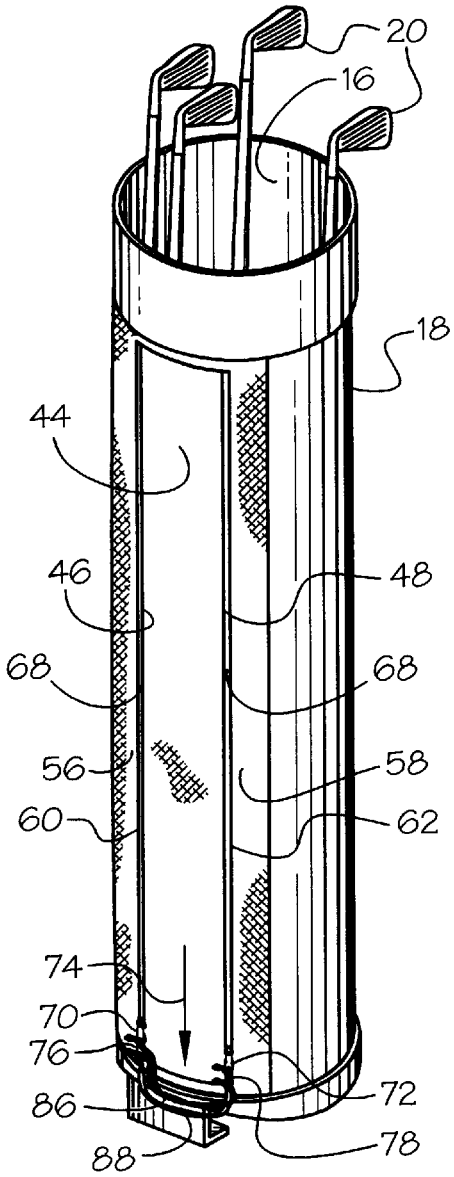
FIGS. 7 and 8 are similar perspective views of the golf bag zipper components as a result, respectively, of descending and ascending movements.
Figure 8:
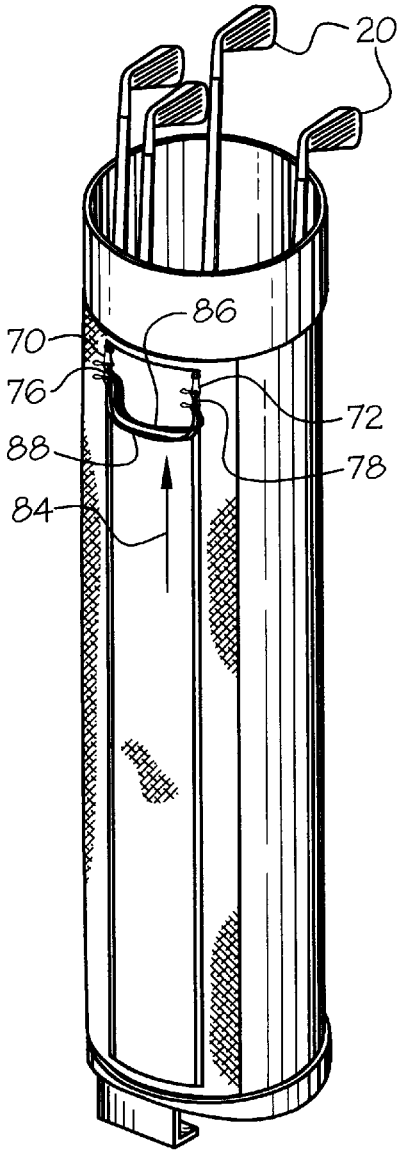

More particularly, appropriated attached, by sewing 59 to the bag rear surface 14, is a longitudinally oriented rectangular panel 44 having opposite edges 46 and 48 in covering relation at the attachment site 12 over the retracted legs 24, 26, said edges 46, 48 being in alignment 50 and 52 (FIGS. 4A, 4B) with a cooperating pivot 32 and 34 (FIG. 2) so that an opening leg pivotal traverse is along a panel edge 46, and along the edge 48 of the panel 44. The facing portions of the bag rear surface 14 and the panel 44 bound therebetween a storage compartment 54.

Cooperating with the panel edges 46 and 48 are left and right flaps 56 and 58 appropriately attached, as by sewing or adhesive 59, to the golf bag 18 in positions outwardly adjacent the panel edges 46 and 48 so edges 60 and 62 on the flaps 56, 58 bound therebetween left and right openings 64 and 66 into the storage compartment 54.

Interengaging and disengaging zipper teeth 68 on strips, and of known construction and operating mode, are deployed on the opening-bounding edges 46, 60 and 48, 62. A first pair of zipper pulls 70 and 72 jointly tracking along the zipper teeth 68 is selected to have an operating mode causing interengaging of said zipper teeth 68 in response to descending movement 74, and a second pair of zipper pulls 76 and 78 jointly tracking below said first pair along said zipper teeth 68 is selected to have an opposite operating mode in which, in response to said descending movement 74, any engaged or interconnected zipper teeth 68 is disengaged. Thus, assuming that the lower second zipper pulls 76 and 78 and the upper first zipper pulls 70 and 72 are at starting positions of movement adjacent the top of the golf bag 18, the urging of these zipper pulls in descending movement alternately cause the opening and closing of the openings 64 and 66; the zipper pulls 76 and 78 causing the opening and the zipper pulls 70 and 72 causing the closing.

In practice, the alternate opening and closing of the openings 64, 66 of the storage compartment 54 are coordinated to the alternate opening and closing of the legs 24, 26 with the consequence that the storage compartment 54 has utility obviating untidiness in the appearance of the tripod leg support 10 as well as preventing possible damage to exposed legs 24, 26 of the tripod support 10.

More particularly, at a site on the fairway for a golf shot, the golfer will use the zipper pulls 76 and 78 to open the openings 64 and 66 and then ground the golf bag 18 causing the opening of the legs 24, 26 and the projection thereof through the openings 64, 66, a happenstance of the vertical alignment 50, 52 of the pivots 32, 34 and the zipper-controlled openings 64 and 66.

After the golf shot, the golf bag 18 is raised resulting in the retraction under spring urgency of the legs 24, 26 back through the openings 64, 66 into the storage compartment 54, this retraction possibly being only partial with the distal ends 80 of the legs 24, 26 not completely making entry filly into the storage compartment 54. The golfer will then close the openings 64, 66 using the first pair of zipper pulls 70 and 72, wherein descending movement along the length portion 82 coincident with the distal ends 80 will cam the distal ends into the storage compartment 54.

During the remainder of play, alternate ascending 84 and descending movement 74 of only the first pair of zipper pulls 70 and 72 will open and close the openings 64 and 66 in coordinated relation to the opening and closing of the legs 24, 26. In preparation for travel from the golf course, and coincidentally also for travel to the golf course, the user is instructed to have both pairs of zipper pulls 70 and 72, and 76 and 78 in their starting positions adjacent the top of the golf bag 18. Ties 86 and 88 are connected in spanning relation between each pair of the zipper pulls are provided to facilitate their movement in unison. Also, if left in their position adjacent the bottom of the golf bag, a position vulnerable to snagging, with an undesirable result. The position adjacent the upper end of the golf bag obviates the snagging problem.

While the apparatus for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. In combination, a tripod leg support of a type having left and right support legs pivotally mounted at upper ends thereof, and leg-operating means for urging said legs in opposite pivotal traverses for opening and closing said legs, and in attached relation a golf bag comprising a body having a circular wall bounding an interior golf club storage compartment, a delineated external surface on said circular wall serving as a rear of said golf bag and a site of attachment of said tripod leg support, a longitudinally oriented rectangular panel with opposite side edges attached to said rear of said golf bag in covering relation over said site of attachment so as to bound beneath said panel and site of attachment a storage compartment, a left and right flap with an edge connected to said golf bag rear surface to position each said flap edge in adjacent facing relation to a cooperating said panel edge so as to bound therebetween left and right openings into said storage compartment, interengaging and disengaging zipper teeth attached to said storage compartment openings-bounding edges, and upper first and lower second pairs of zipper pulls disposed for tracking along said zipper teeth, said operating modes during said tracking of said zipper pulls being opposite to each other so that in response to descending movement said first pair of zipper pulls causes disengaging of said zipper teeth and said second pair of zipper pulls causes interengaging of said zipper teeth, whereby alternate tracking of said zipper pulls correspondingly alternates said opening and closing of said storage compartment in coordinated relation to said opening and closing of said support legs.

* * * * *